United States Patent [19]

Nilsson

[11] 4,312,469

[45] Jan. 26, 1982

[54] FEEDING APPARATUS

[76] Inventor: Rune Nilsson, Storgatan 14, S-330 20 Anderstorp, Sweden

[21] Appl. No.: 117,508

[22] Filed: Feb. 1, 1980

[30] Foreign Application Priority Data

Feb. 7, 1979 [SE] Sweden ..... 7901054

[51] Int. Cl.[3] ..... B65H 17/44; B65H 17/36

[52] U.S. Cl. ..... 226/150; 226/162

[58] Field of Search ..... 226/150, 151, 141, 145, 226/158, 159, 162

[56] References Cited

U.S. PATENT DOCUMENTS

| | | | |
|---|---|---|---|
| 2,467,740 | 4/1949 | Haller | 226/150 |
| 2,622,874 | 12/1952 | Haller | 226/150 |
| 3,937,379 | 2/1976 | Narwid | 226/162 |
| 4,167,239 | 9/1979 | Bihler | 226/150 |

FOREIGN PATENT DOCUMENTS

| | | |
|---|---|---|
| 1574348 | 8/1969 | Fed. Rep. of Germany . |
| 1810709 | 6/1970 | Fed. Rep. of Germany . |
| 2321209 | 11/1973 | Fed. Rep. of Germany . |
| 2346063 | 4/1974 | Fed. Rep. of Germany . |
| 2647734 | 10/1976 | Fed. Rep. of Germany . |
| 651133 | 3/1951 | United Kingdom . |
| 737771 | 9/1955 | United Kingdom . |
| 1056592 | 1/1967 | United Kingdom . |
| 1137014 | 12/1968 | United Kingdom . |

*Primary Examiner*—Edward J. McCarthy

*Attorney, Agent, or Firm*—Birch, Stewart, Kolasch & Birch

[57] ABSTRACT

There is provided a measuring apparatus for successively and intermittently feeding one or more elongate workpieces (A) to a working machine. Between an attachment means (2) and a fixed clamping element (4) there is arranged a further clamping element (7) which is reciprocatingly movable along a pair of guides (6). As the movable clamping element (7) makes a working stroke, the workpiece (A) is able to pass freely through the fixed clamping element (4). Upon return movement of the movable clamping element (7), however, the workpiece is held by the fixed clamping element, with the movable clamping element (7) returning to its rearward limit position out of engagement with the workpiece. The movable clamping element (7) is connected, via a piston rod (10), to the piston (9) of a pneumatic cylinder (8) of variable volume, said cylinder having an end plate (11) which is displaceable therein. The end plate (11) is held in selected positions along the cylinder (8) by means of a displaceable clamping ring (12) arranged to co-operate with a screw and nut arrangement (13). The end plate (11) has arranged therein a compressed-air connection (16), a damper (18), and a reversing valve (19), and defines the rear limit position of the movable clamping element (7). The forward limit position of said clamping element is determined by a reversing valve (39) arranged in said movable clamping element and adapted to co-act with a movable abutment (27) in the fixed clamping element (4). The length of stroke of the apparatus can be roughly set by positioning the end plate (11) in the cylinder (8) and then finely adjusting the setting of the working stroke (27).

14 Claims, 7 Drawing Figures

FEEDING APPARATUS

BACKGROUND AND SUMMARY OF INVENTION

The present invention relates to an automatically operating apparatus for feeding one or more elongate workpieces, such as strip-metal, tubular sections or profiled sections, to one or more working machines, for example shearing machines, punching machines, stamping machines, drilling machines and/or welding machines. The feeding apparatus is constructed for intermittently feeding stepwise an elongate workpiece along a given path and comprises, inter alia, a fixed and a movable clamping element. The workpiece is clamped in the movable clamping element and moved thereby to the working machine, with the fixed clamping element out of engagement with said workpiece. When the grip of the movable clamping element is released and said element is withdrawn, the workpiece is released therefrom and the fixed clamping element is moved into engagement with said workpiece. The length of the path of movement of said elongate workpiece is determined by limit switches arranged at respective ends thereof.

Known feed mechanisms of the aforedescribed kind are encumbered with a number of disadvantages. For example, the clamping force exerted by the movable clamping element is not always satisfactory. Further, since the aforementioned limit switches are not normally provided with the feeding apparatus when purchasing the same, they must be bought separately and installed by the customer, thereby complicating the process of setting those feeding apparatus available on the market at present to the correct length of feed stroke.

One object of the present invention is to provide a novel feeding apparatus of the aforedescribed kind which is reliable in operation and with which the length of feed stroke can be readily adjusted, and with which said length of feed stroke can be finely adjusted while the apparatus is in operation. A further object of the invention is to provide a feeding apparatus which, while operating at a high speed, requires the minimum of energy, and which can be readily adapted to work with different working machines.

Accordingly the present invention comprises an apparatus for intermittently feeding elongate workpieces stepwise in the direction of their longitudinal axis along a given path, said apparatus including a frame structure having a drive unit and a fixed clamping element; a further clamping element arranged for movement along said path, said further clamping element being so arranged that it will advance the workpiece when moving in one direction but will not move said workpiece when moving in the opposite direction, characterized in that the movable clamping element is connected, through a piston rod, to a piston which, in the direction of said movement path, cooperates with a pressure cylinder having a rear end plate which is displaceably arranged in said cylinder so as to alter the volume thereof and therewith the length of stroke of the movable clamping element; and in that a clamping ring which is displaceable on said cylinder is arranged to be clamped around the cylinder in a manner such as to compress the same around said end plate for fixing said plate in the desired position along the length of the cylinder.

BRIEF DESCRIPTION OF THE DRAWINGS

An exemplary embodiment of the invention will now be described with reference to the accompanying drawings, in which.

DETAILED DESCRIPTION OF THE INVENTION

Figure 1:
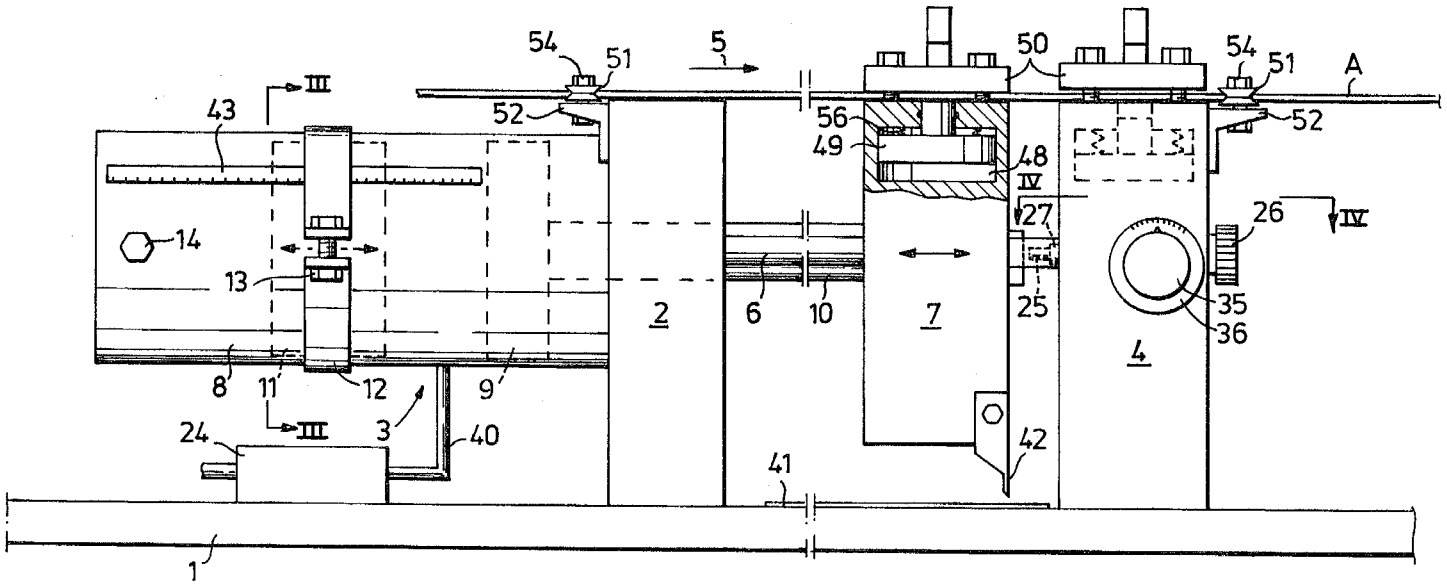
FIG. 1 is a side view of the feeding apparatus.

Mounted on a frame structure 1, which is located adjacent a working machine (not shown), is an attachment means 2 for a drive unit 3, and a fixed stationary clamping element 4. The attachment means 2 and the clamping element 4 are connected together by means of two mutually parallel guides 6 which extend in the direction of feed 5, on which guides 6 a clamping element 7 is sideably mounted for reciprocatory movement.

A cylinder 8 is mounted on one end in the attachment means 2 in a manner such that said attachment means serves as the front end wall of the cylinder. Arranged for movement in the cylinder 8 is a piston 9 which is connected to the movable clamping element 7 through a piston rod 10. The active volume of the cylinder is determined by a rear end plate 11 which is arranged for movement in said cylinder and which is held in a selected position therealong by means of a clamping ring 12 extending around said cylinder, said clamping ring being arranged to be moved along the cylinder to a position in register with the selected position of the end plate 11, whereafter the clamping ring 12 is tightened around the cylinder by means of a clamping device, such as a knot-and-bolt arrangement 13. The cylinder is compressed in this way around the end plate 11, to secure the same in the position to which it has been moved. The clearance between the peripheral surface of the end plate and the inner wall of the cylinder is minimal, and hence the wall of the cylinder need not be compressed to any great extent in order to securely hold the end plate 11. In order to prevent the end plate 11 from being unintentionally removed from the cylinder, the rear end of the cylinder 8 is provided with a screw-threaded hole into which a screw 14 is screwed so as to project into the rearward path of the end plate 11. Alternatively, a circlip can be arranged internally of the cylinder.

An elongate workpiece A is progressively advanced intermittently in its longitudinal direction by causing the movable clamping element 7 when located in a withdrawn position, i.e. the rearward limit position of said element, to grip the workpiece and to move said workpiece during forward movement of said clamping element in the direction of feed 5, to a forward limit position. During this feeding stroke, the workpiece passes freely through the fixed clamping element 4, although said fixed clamping element also grips the workpiece when said forward limit position is reached, whereafter the movable clamping element releases its grip on the workpiece and is returned to its rear limit position. The movable clamping element then re-grips the workpiece, whereupon the grip of the fixed clamping element is relinguished and the feeding movement repeated. The feeding movement of the movable clamping element 7 is effected by supplying air under pressure to the cylinder 8 through a passage 16 arranged in the end plate 11, the piston 9 being moved in the feed direction 5 and the movement of said piston being transmitted to the movable clamping element via the piston 10. Return movement of the movable clamping element is effected in a similar manner, by supplying air under pressure to the cylinder 8 through a passage 15 in the attachment means 2.

Figure 3:
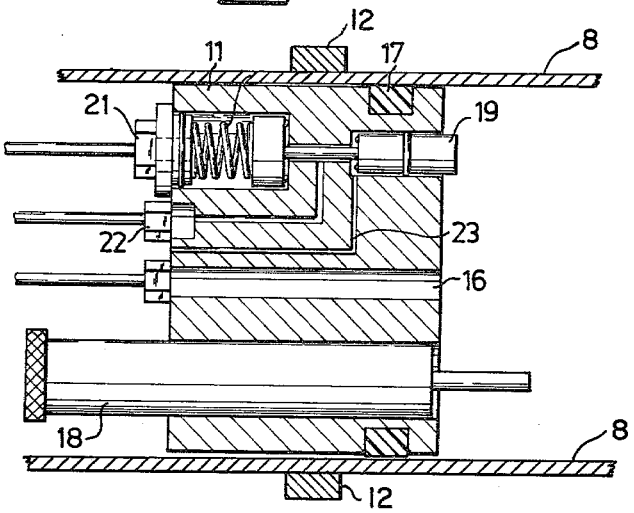
FIG. 3 is an axial sectional view through said end plate taken along line III—III.
Figure 4:
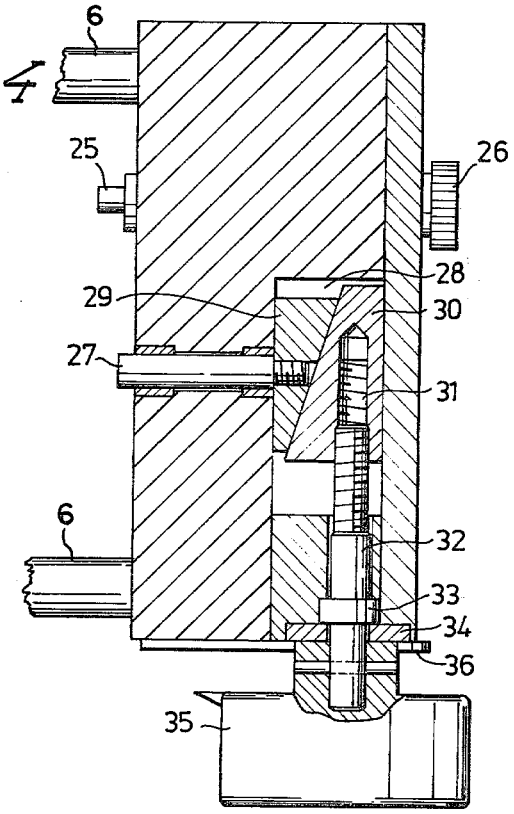
FIG. 4 is a horizontal sectional view taken along line IV—IV through the fixed clamping element and through an adjustable abutment by means of which fine adjustment of the length of stroke of said feeding apparatus is effected.

As will best be seen from FIG. 3, in addition to including the passage 16 for supplying air to the cylinder 8 and for venting said cylinder, the displaceable end plate 11 is also provided with a sealing ring 17, a regulateable damping means 18 and a reversing valve 19 having a compression spring 20. The said end plate 11 also includes a connection 21 for connecting said plate to a source of air under pressure, a signal-air connection 22 and a venting passage 23 for said signal-air to effect a given function thereof. By signal air is meant an air signal to the control means. As will be understood, the end plate 11 constitutes a means for stopping the movement of the piston 9 in its return stroke, and hence the position at which the end plate is fixed in the cylinder defines the rearward turning or limit position of the movable clamping element 7. The damping means 18 dampens the movement of the piston at the end of its rearward stroke, in order to soften the contact of the piston with said end plate.

The reversing valve 19, which is arranged for axial displacement in the end plate 11, is spring-biassed and compressed-air biassed in a direction towards the piston 9. The pressure spring 20 is arranged to compensate the compressed air in the cylinder, so that the valve can not be opened when compressed air is supplied to the cylinder through the passage 16.

At the end of its return stroke, and immediately before contacting the end plate 11, the piston 9 strikes the reversing valve 19, which is then displaced to the left in FIG. 3 to an open position. Air under pressure then passes the left part of the valve and out through the signal-air connection 22, to a control unit 24 for reversing the direction of movement of the piston. Compressed air is then passed through the passage 16 to the cylinder 8, while air is ventilated through the passage 15 in the attachment means 2. The signal-air line is evacuated through a passage 23.

Because the displaceable end plate 11 includes air-supply means, damping means and said reversing valve, and, at the same time, serves as stop means for rearward movement of the piston, it is a simple matter to alter the length of stroke of the feeding apparatus. All that is required in order to set the apparatus ready for use is to loosen the nut-and-bolt arrangement 13 and to move the end plate 11 (and the clamping ring 12) to the desired position along the cylinder 8, and then tighten said screw and nut arrangement. At the same time an optimal volume of the cylinder is obtained, since the top-dead-centre of the piston is at the end plate 11.

The fixed clamping element 4 forms a stop for the feed stroke of the movable clamping element 7 and thus also for the movement of piston 9 to the right cylinder 8 as seen in FIG. 1.

Arranged in the fixed clamping element 4 is a damper means 25 whose damping effect can be adjusted by means of a device 26, and an axially movable abutment 27. The fixed clamping element 4 is also provided with a horizontal, rectangular recess 28 which accommodates two mutually co-operating wedges 29 and 30. One of said wedges 29 is connected to the abutment 27. The other of said wedges, 30, is provided with a screwthreaded bore 31, in which a meshing peg 32 is screwed. The peg is also pivotally mounted on the clamping element 4 and is provided with a flange 33 which, together with a plate 34 mounted on said fixed clamping element, prevents axial movement of the peg. A setting wheel or knob 35 is mounted on the free end of the peg 32, and the fixed clamping element 4 exhibits a scale 36 which shows the setting of the knob or wheel 35. The wedge 30 can be displaced in the longitudinal direction of the peg by rotating the knob or wheel 35. The wedge 29 transmits movement of the wedge 30 to the abutment 28, thereby adjusting the setting of said abutment.

Figure 2:
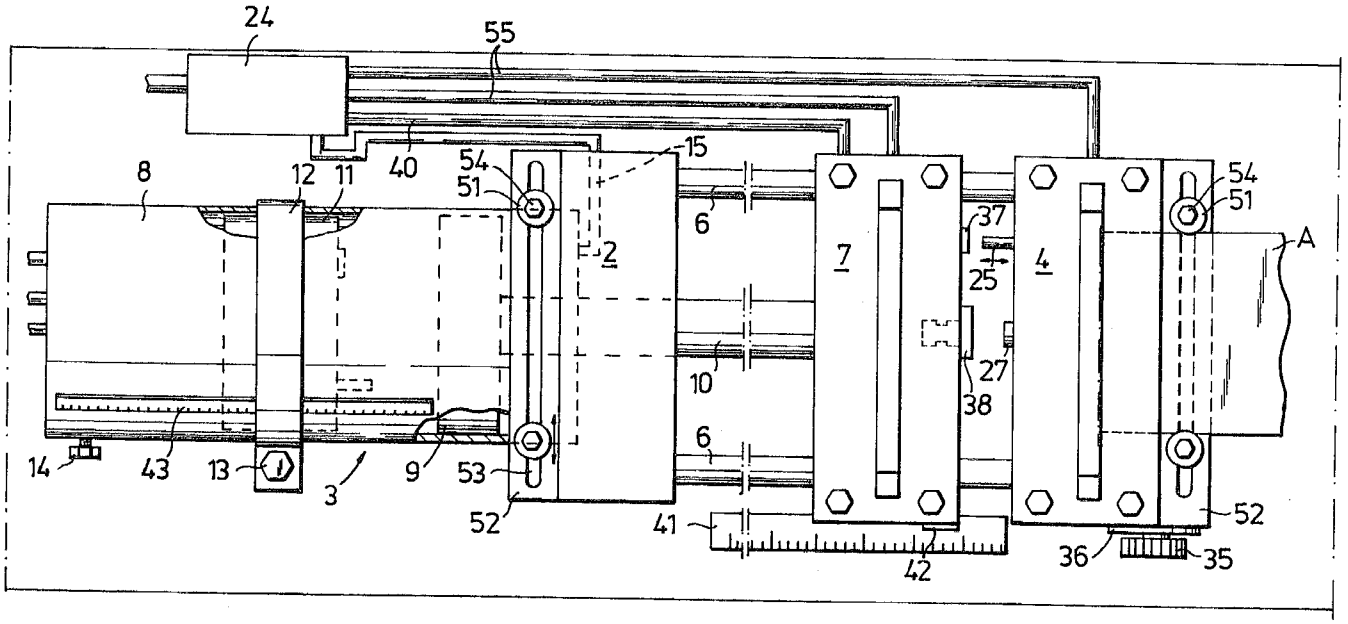
FIG. 2 is a plan view of said feeding apparatus.

Referring to FIG. 2 the movable clamping element 7 includes a shoulder 37, and a further shoulder 38 having arranged therein a bore (not shown). Arranged in the bore within the movable clamping element is an axially displaceable reversing valve 39. The reversing valve 39 is of similar construction to the reversing valve 19 in the displaceable end plate 11. Since the valve 39 is not subjected to any counter pressure, it has not been provided with the pressure spring 20. A signal-air line 40 connects the reversing valve 39 to the control unit 24.

At the end of a feeding stroke, the shoulder 37 of the movable clamping element 7 comes into contact with the damper 25, thereby damping the movement of said clamping element. The reversing valve 39 contacts the abutment 27, causing the reversing valve to be moved to the left in FIG. 2 to an open position. Air under pressure then passes out through the signal-air line 40 to the control unit 24, for reversing the direction of movement of the piston. Air under pressure is then supplied to the cylinder 8 through the passage 15 in the attachment means 2, while air is permitted to escape through the passage 16 in the end plate 11.

The length of stroke of the apparatus can be finely adjusted by adjusting the forward limit position of the movable clamping element 7, this being effected by displacing the abutment 27 in its longitudinal direction, by turning the setting knob 35. As indicator on the knob 35 moves along a scale 36 to show the setting of the abutment 37. The design of the fine-adjustment means enables the length of stroke of the feeding apparatus to be finely adjusted while the apparatus is in operation.

To enable the length of stroke of the apparatus to be roughly set a measurement scale 41 is arranged on the frame structure parallel to the guides 6, said rough setting being effected by adjusting the rear limit position of the movable clamping element 7. The adjustment can be effected by providing the movable clamping element with an indicating means, for example a needle 42, which is moved along the scale as the clamping element is moved. The position of the clamping element is read-off on the scale by means of the needle. A corresponding scale 43 is provided on the cylinder 8. When the clamping element is set to the desired position, the end plate 11 is displaced so that it contacts the piston 8. The clamping ring 21 is then positioned with the aid of the scale 43 on the cylinder 8, so that it adopts a position in which it is located around the cylinder and the end plate 11, whereafter the nut-and-bolt arrangement 13 is tightened.

Figure 5:
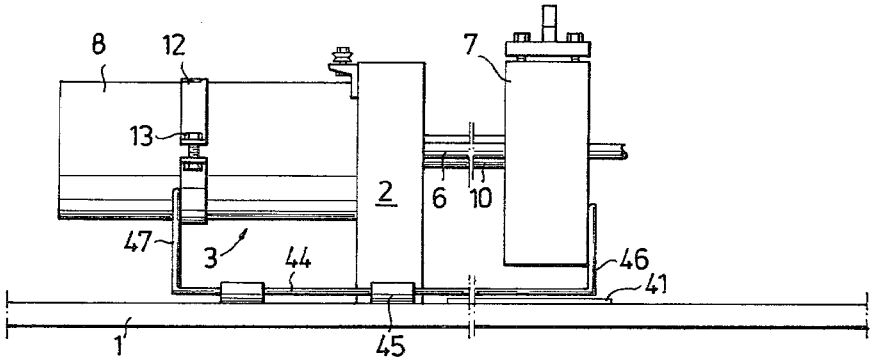
FIGS. 5, 6 and 7 illustrate alternatives for roughly setting the length of stroke of the movable clamping element.

Alternatively, as illustrated in FIG. 5, a structure 44 of substantially U-shaped configuration when seen in cross-section can be used for setting the clamping ring 12, instead of the scale 43. The structure 44 is pivotally arranged for displacement along the scale 41 in a plurality of spaced-apart sleeves 45 welded on the frame structure 1, and having a length between the forward leg 46 and the rearward leg 47 of said U-shaped structure which corresponds approximately to the sum of the thickness of the movable clamping element, the length of the piston rod 10, the thickness of the piston 9 and the thickness of the end plate 11. The positional setting of the clamping ring 12 on the cylinder 8, for roughly setting the length of stroke of the apparatus in accordance with the above, is effected by displacing the leg 46 of the substantially U-shaped structure 44 along the scale 41 to a desired rearward limit position for the clamping element 7. The clamping element is then moved from a rearward position to a position in which its leading surface is in contact with the uppraised leg 46 of the structure 44. The rearward leg 47 of said structure then rests against the cylinder 8, and when displacing the clamping ring 12 rearwardly into contact with the leg 47, a correct position of the clamping ring is obtained. The use of a substantially U-shaped structure 44 instead of duplicating the provision of scales for setting the clamping ring to the desired position eliminates any risk of error in the setting of said ring.

Figure 6:
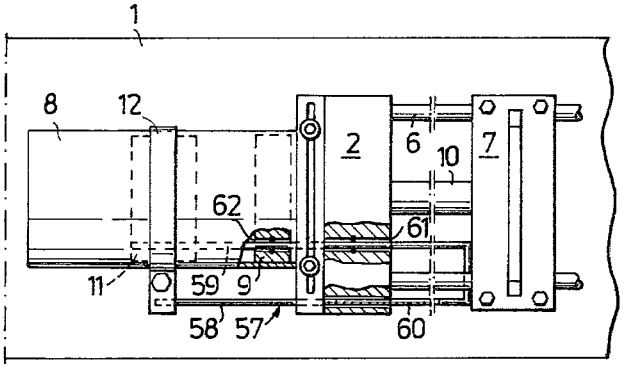

A further embodiment of a device for roughly setting the length of stroke of the apparatus is illustrated in FIG. 6. This device comprises a stirrup-like structure generally shown at 57 having legs 58 and 59 of approximately equal length and displaceably arranged in the attachment means 2. One leg, 58, is provided with a measurement scale 60 and is attached to the ring 12. The other leg, 59, extends through a bore in the attachment means 2. One leg, 58, is provided with a measurement scale 60 and is attached to the ring 12. The other leg, 59, extends through a bore in the attachment means 2 and in the piston 9 and is connected to the end plate 11, said bore being provided with a seal (not referenced). In order to set the apparatus to a desired working stroke, the clamping ring is moved to a desired position along the cylinder 8, while using the scale on the leg 58, thereby moving at the same time the end plate 11, which as a result of the construction of the stirrup-like structure is always located in register with the clamping ring 12. As will be understood, the scale 41 arranged on the frame-structure is unnecessary.

It is also possible to modify the apparatus described above in a manner such that only one leg 58 provided with a scale is necessary, in which case said structure has a length which corresponds approximately to the length of the stroke of piston rod 10, the thickness of the piston 9 plus half the thickness of the end plate. The length of stroke of the apparatus is set by means of the scale 60, whereafter the leg 58 is locked in the attachment means 2 and the movable clamping element 7 is moved into contact with the free end of said leg. The end plate 11 is then brought into contact with the piston 9, and the nut-and-bolt arrangement 13 of the clamping ring tightened.

Figure 7:
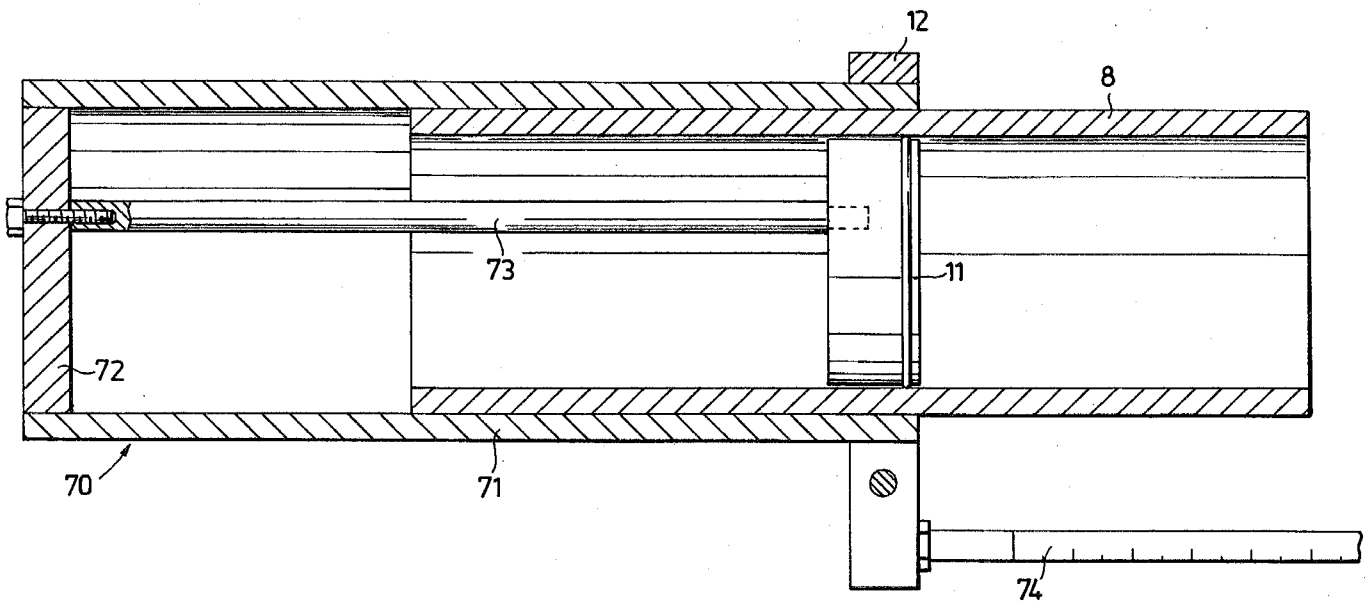

In accordance with a best mode, FIG. 7, however, rough setting of the length of stroke of the movable clamping element 7, is effected by a sleeve-like element generally shown at 70, said element including an outer sleeve 71 and an end piece 72. The inner extremity of the sleve 71 is fixed in the clamping ring 12, so that axial movement of the sleeve 71 results in similar movements of said ring. Extending between the end piece 72 and the end plate 11 is a distance element 73, said element being fixed to said plate and said end piece, so that axial movement of said distance causes the end plate to be moved through a corresponding distance. The clamping ring 12 has mounted thereon in a manner similar to the FIG. 6 embodiment, a scale 74, from which the rough setting of the ring 12 and the end plate 11 can be read. It will be evident that with this embodiment, the ring 12 and plate 11 are always in register with one another.

Arranged in the clamping element beneath the workpiece A is one or more vertically oriented cavities 48, in which pistons 49 having a connecting part are movable transversely of said workpiece. By supplying compressed air at 55 through the control unit 24 to the lower part of the piston housing, the piston 49 is urged against the workpiece, which in turn is urged against the upper part 50 of the clamping elements. The workpiece is therewith in friction engagement with said clamping element. For the purpose of quickly releasing the engagement of the clamping elements with the said workpiece, pressure springs 56 are arranged between the upper part of the piston housing and said piston. When the workpiece to be fed to the working machine is a profiled workpiece, the illustrated upper part of respective clamping elements can be replaces with a grooved upper part.

For the purpose of guiding the workpiece A through the feeding apparatus, two pairs of mutually co-operating guide wheels 51 are rotatably mounted on horizontal bracket structures 52 adjacent the attachment means 2 and the fixed clamping element 4 respectively. As will be seen from FIG. 2, the bracket structures 52 are provided with slots or grooves 53 extending transversely of the path of travel of the workpiece A, so that the pairs of wheels 51 can be adjusted to guide said workpiece. The guide wheels can be locked in place in the grooves or slots 53 by, for example, a nut and bolt arrangement 54 extending through the wheel journals and the bracket structure. As will be understood, the guide wheels can be exchanged for guide jaws. The number of guide wheels arranged in the bracket structures will, of course, increase with the number of workpieces to be fed simultaneously to the working machine.

The upper surfaces of the clamping elements on which the workpieces are slidable, and also the upper surface of the attachment means 2, can be coated with a friction reducing substance, such as polytetrafluoroethylene (Teflon ®), to facilitate feeding of the workpiece to the working machine.

Suitably the control unit 24 can be coupled to the working machine in a manner such that the working tool of said maching is brought into contact with the workpiece when the movable clamping element is in its forward limit position. When a longer feed distance is required, the control unit can be set so that the movable clamping element executes two or more feed strokes before the said machining tool is activated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An apparatus for intermittently feeding an elongate workpiece stepwise in its longitudinal direction in a given path, comprising a frame structure having fixedly mounted thereon a first stationary clamping means and an attachment means arranged in spaced relationship with said first clamping means;

second clamping means arranged for rectilinear movement between said attachment means and said first clamping means, said first and said second clamping means being so arranged that the movalbe clamping means advances said workpiece when moving in one direction but not when moving in a direction opposite to said one direction;

a piston-cylinder device having a piston rod connected at one end thereof to said second clamping means for effecting movement of said means laong said workpiece's longitudinal direction;

end plate means displaceably arranged in the cylinder of said piston-cylinder-device such as to enable the volume of said cylinder to be changed;

a clamping ring displaceably arranged on the outer wall of said cylinder such as to enable said clamping ring to be moved into register with the peripheral surface of said end plate, and means co-acting with said clamping ring to clamp said ring about said cylinder wall and thus also about said peripheral surface of said end plate means.

2. An apparatus according to claim 1, characterized in that the end plate comprises a sealing ring;

a supply connection for supplying pressure medium to said cylinder dampening means for dampening movement of said piston at the end of its return stroke; and a reversing valve which is axially displaceable in the end plate and which is biassed by means of a spring force and a pressure medium in a direction towards the piston, said valve when contacting said piston being arranged to deliver a signal through said pressure medium to a control unit for reversing the movement of said piston.

3. An apparatus according to claim 1, characterized in that said first clamping element is provided with an adjustable damper for damping the movement of the movable clamping element at the end of a feeding stroke; and abutment means capable of being adjusted in the longitudinal direction of said movement path and during operation of said apparatus, to finely adjusting the length of stroke of said second clamping means; and in that a pressure-medium biassed reversing valve is arranged in the second clamping element (7), when contacting the abutment to generate a signal through said pressure medium to the control unit for reversing the direction of movement of said piston.

4. An apparatus according to claim 1, characterized by an indicating means, which is arranged to be displaced along a measurement scale arranged on the frame structure upon displacement of the second clamping means for roughly setting the length of stroke of said means, and a means which is arranged, when said length of stroke is set, to indicate the position of said end plate upon its contact with the piston (9) for setting and clamping the clamping ring around said cylinder and said end plate.

5. An apparatus according to claim 1, characterized in that it includes at least two pairs of guide wheels capable of being adjusted transversely of said movement path and arranged for guiding the workpiece through the feeding apparatus.

6. An apparatus according to claim 1, characterized in that each of the first and second clamping means includes a pneumatically operated workpiece—clamping arrangement; wherein the pressure medium for driving the piston in the cylinder of said piston-cylinder-device and for generating the reversing signals is compressed air.

7. An apparatus for intermittently feeding an elongate workpiece stepwise in the direction of its longitudinal axis along a given path, said apparatus comprising:

a frame structure;

first workpiece—clamping means stationarily fixed on a support surface of said frame structure;

attachment means fixedly mounted on said support surface of said frame structure in spaced—apart relationship with said first, fixed clamping means;

second workpiece—clamping means arranged for movement along part of said workpiece movement path, horizontally between said first clamping means and said attachment means;

said first and second clamping means each having a workpiece-clamping arrangement so that said workpiece is moved by said second clamping means in one direction of travel thereof, but not in its direction of travel opposite to said one direction;

adjustable means co-acting with said second movable clamping means to move said means between said attachment means and said first, stationary clamping means; and drive means cooperating with said adjustable means, said adjustable means having means for adjusting the length of the working stroke of said second movable clamping means.

8. An apparatus according to claim 7 in which said adjustable means comprises a piston-cylinder device having a piston rod which is connected at one end thereof to said second clamping means; and in which there is arranged in said cylinder for movement to selected locations therealong an end plate means which is lockable in said selected locations by means of a locking device displaceably arranged on the outer surface of said cylinder.

9. An apparatus according to claim 8, in which said end plate means includes a sealing ring for sealing said end plate against the inner surface of said cylinder; a supply connection for supplying pressure medium to said cylinder; damping means for damping movement of said piston at the end of its return stroke; and a force-biassed reversing valve arranged for axial movement in said end plate means; and means co-acting with said reversing valve for delivering a signal to a control unit for reversing the movement of said piston when said piston reaches contact with said valve.

10. An apparatus according to claim 7, in which said first clamping element is provided with adjustable damping means arranged to damp movement of the movable clamping means at the end of a feeding stroke; and abutment means capable of being adjusted in the longitudinal direction of said movement path and during operation of said apparatus, to finely adjust the length of stroke of said second clamping means; and in which said second clamping means is provided with a force-biassed reversing valve arranged, when reaching contact with said abutment means of said first clamping means, to generate a signal to said control unit for reversing the direction of movement of said piston.

11. An apparatus according to claim 1, in which there is provided registering means operable to roughly set the length of stroke of said second clamping means.

12. An apparatus according to claim 11, in which the apparatus has further registering means operable, when said length of stroke is roughly set, to indicate the position of said end plate means when it contacts said piston, to enable said clamping ring to be moved into register with said end plate means.

13. An apparatus according to claim 11, in which said registering means includes a sleeve-like element arranged for axial movement along the outer wall of said cylinder, one end of said sleeve-like element being firmly fixed to said clamping device, and further includes a distance piece which extends within the cylinder substantially parallel to the wall thereof, and which is firmly fixed to the said end plate, the arrangement being such that the locking device is constantly in register with said end plate.

14. An apparatus according to claim 7, in which each of the first and second clamping means comprises an internal cavity arranged to receive one end plate of a plunger arrangement, said one end plate being mounted on the end of a stem which carries at its other end a further end plate, said cavities communicating with a source of pressure medium, and said one end plate being movable in a respective cavity transversely of the direction of travel of said workpiece, which workpiece is arranged to be located between said further end plates of said plunger arrangement and an adjacent wall surface of a respective clamping means.

* * * * *